US008814546B2

(12) United States Patent
Lee et al.

(10) Patent No.: US 8,814,546 B2
(45) Date of Patent: Aug. 26, 2014

(54) COMPRESSOR

(75) Inventors: Kang-Wook Lee, Changwon-si (KR); Bum-Dong Sa, Gimhae-si (KR); Se-Seok Seol, Changwon-si (KR); Seoung-Min Kang, Gimhae-si (KR); Jin-Ung Shin, Changwon-si (KR)

(73) Assignee: LG Electronics Inc., Seoul (KR)

( * ) Notice: Subject to any disclaimer, the term of this patent is extended or adjusted under 35 U.S.C. 154(b) by 83 days.

(21) Appl. No.: 13/388,112

(22) PCT Filed: Dec. 2, 2009

(86) PCT No.: PCT/KR2009/007165

§ 371 (c)(1),
(2), (4) Date: Jan. 31, 2012

(87) PCT Pub. No.: WO2011/019113

PCT Pub. Date: Feb. 17, 2011

(65) Prior Publication Data

US 2012/0141312 A1 Jun. 7, 2012

(30) Foreign Application Priority Data

Aug. 10, 2009 (KR) ..... 10-2009-0073278
Aug. 10, 2009 (KR) ..... 10-2009-0073281
Aug. 10, 2009 (KR) ..... 10-2009-0073282
Aug. 10, 2009 (KR) ..... 10-2009-0073283

(51) Int. Cl.

| | |
|---|---|
| ***F01C 21/00*** | (2006.01) |
| ***F04D 15/00*** | (2006.01) |
| ***F01C 21/04*** | (2006.01) |
| ***F01C 21/06*** | (2006.01) |
| ***F03C 2/00*** | (2006.01) |
| ***F03C 4/00*** | (2006.01) |
| ***F04C 2/00*** | (2006.01) |
| ***F01C 1/02*** | (2006.01) |
| ***F04C 18/32*** | (2006.01) |
| ***F04C 23/02*** | (2006.01) |
| ***F04C 29/02*** | (2006.01) |
| ***F04C 29/00*** | (2006.01) |
| ***F01C 21/02*** | (2006.01) |
| ***F04C 18/356*** | (2006.01) |

(52) U.S. Cl.

CPC ..... *F04C 18/3564* (2013.01); *F04C 2270/12* (2013.01); *F04C 18/322* (2013.01); *F04C 23/02* (2013.01); *F04C 29/023* (2013.01); *F04C 2240/10* (2013.01); *F04C 29/0071* (2013.01); *F04C 2240/52* (2013.01); *F04C 2240/40* (2013.01); *F01C 21/02* (2013.01); *F04C 2240/30* (2013.01); *F04C 2240/60* (2013.01); *F04C 29/0085* (2013.01)

USPC ..... 418/183; 418/83; 418/60; 418/63

(58) Field of Classification Search

CPC ..... F04C 2240/00; F04C 2240/10; F04C 18/322; F04C 29/005; F04C 29/0071; F04C 29/023; F04C 2240/40; F04C 2240/52; D04C 2240/60

USPC ..... 418/183, DIG. 1, 83, 60, 63

See application file for complete search history.

(56) References Cited

U.S. PATENT DOCUMENTS

| | | | | |
|---|---|---|---|---|
| 2,420,124 | A * | 5/1947 | Coulson | 417/356 |
| 2,440,593 | A * | 4/1948 | Miller | 418/88 |
| 5,542,831 | A * | 8/1996 | Scarfone | 418/60 |
| 5,950,452 | A | 9/1999 | Sakitani et al. | |
| 6,094,815 | A * | 8/2000 | Shigihara et al. | 29/888.025 |
| 6,889,419 | B2 * | 5/2005 | Reiter et al. | 29/596 |
| 7,217,110 | B2 | 5/2007 | Dreiman | |
| 2005/0031465 | A1 | 2/2005 | Dreiman et al. | |
| 2007/0041860 | A1 * | 2/2007 | Nakamoto et al. | 418/123 |
| 2007/0065324 | A1 * | 3/2007 | Masuda | 418/29 |

FOREIGN PATENT DOCUMENTS

| | | |
|---|---|---|
| CN | 1138365 | 12/1996 |
| JP | 62-284985 | 12/1987 |
| JP | 01-100291 | 4/1989 |

OTHER PUBLICATIONS

International Search Report issued in PCT Application No. PCT/KR2009/007165 dated Feb. 19, 2010.
Chinese Office Action dated Feb. 11, 2014. (translation).

* cited by examiner

*Primary Examiner* — Theresa Trieu
*Assistant Examiner* — Deming Wan
(74) *Attorney, Agent, or Firm* — Ked & Associates, LLP

(57) ABSTRACT

A compressor is provided in which a rotary member is suspended on a stationary member and rotates to compress a refrigerant. In the stationary member, top and bottom ends of a stationary shaft are fixed to improve structural stability and assembly properties. Bearing covers are provided on a contact portion of the stationary member and the rotary member, such that the rotary member may rotate when suspended on the stationary member, which stabilizes operation. In the rotary member, a vane is integrally formed with a roller and mounted on a vane mounting hole of a cylinder-type rotor. Although, the rotary member is provided on an outer circumferential surface of the stationary member, suction and discharge operations of the refrigerant are performed in an axial direction, which lowers product height. Oil stored in a hermetic container is supplied to a lubrication passage provided between the stationary member and the rotary member.

19 Claims, 9 Drawing Sheets

COMPRESSOR

TECHNICAL FIELD

The present invention relates to a compressor in which a rotary member suspended on a stationary member is rotated to compress the refrigerant, and more particularly, to a compressor which can achieve the structural stability, improve an assembly property, reduce the vibration, prevent refrigerant leakage to improve the compression efficiency, effectively perform the suction and discharge of the refrigerant, and improve the lubrication performance.

BACKGROUND ART

In general, a compressor is a mechanical apparatus receiving power from a power generation apparatus such as an electric motor, a turbine or the like, and compressing the air, refrigerant or various working gases to raise a pressure. The compressor has been widely used for electric home appliances such as refrigerators and air conditioners, and application thereof has been expanded to the whole industry.

The compressors are roughly classified into a reciprocating compressor in which a compression space into/from which a working gas is sucked and discharged is defined between a piston and a cylinder and the piston is linearly reciprocated in the cylinder to compress the refrigerant, a rotary compressor in which a working gas is compressed in a compression space defined between an eccentrically-rotated roller and a cylinder, and a scroll compressor in which a compression space into/from which a working gas is sucked and discharged is defined between an orbiting scroll and a fixed scroll and the orbiting scroll is rotated along the fixed scroll to compress the refrigerant.

While the reciprocating compressor has excellent mechanical efficiency, this reciprocating motion causes serious vibration and noise problems. In order to solve the foregoing problems, the rotary compressor has been developed due to its compact structure and excellent vibration characteristic.

The rotary compressor is configured such that a motor unit and a compression mechanism unit are mounted on a driving shaft in a hermetic container. A roller located near an eccentric portion of the driving shaft is located in a cylinder defining a cylindrical compression space, one or more vanes extend between the roller and the compression space to partition the compression space into a suction region and a compression region, and the roller is eccentrically located in the compression space. In general, the vane is supported on a groove portion of the cylinder by a spring to pressurize a surface of the roller, and the compression space is partitioned into the suction region and the compression region by the vane as mentioned above. With the rotation of the driving shaft, the suction region is gradually increased such that the refrigerant or working fluid is sucked into the suction region, and at the same time, the compression region is gradually decreased such that the refrigerant or working fluid therein is compressed.

In the conventional rotary compressor, since the motor unit and the compression mechanism unit are stacked on the upper and lower sides, the overall height of the compressor is inevitably increased. Moreover, in the conventional rotary compressor, since the motor unit and the compression mechanism unit have different weights, a difference in the force of inertia and a problem of unbalance are generated on the upper and lower sides of the driving shaft. Therefore, in order to compensate for the unbalance between the motor unit and the compression mechanism unit, a weight member may be superimposed on a relatively small weight side. However, this applies an additional load to a rotary body, thereby reducing the driving efficiency and the compression efficiency. Further, in the conventional rotary compressor, the eccentric portion is formed on the driving shaft in the compression mechanism unit. The eccentric portion is rotated with the rotation of the driving shaft to drive the roller located outside the eccentric portion. As a result, the vibration is inevitably generated in the compression mechanism unit due to the eccentric rotation of the driving shaft and the eccentric portion. Furthermore, in the conventional rotary compressor, when the eccentric portion of the driving shaft is rotated, it is continuously in sliding-contact with an inner surface of the cylinder with the roller fixed thereto and a tip section of the vane with the roller fixed thereto. A high relative velocity is present between the components brought into sliding-contact, which generates a friction loss and leads to reduction of the efficiency of the compressor. Additionally, a refrigerant leakage probability is present on a sliding-contact surface between the vane and the roller, which degrades the mechanical reliability.

While the conventional rotary compressor is configured such that the driving shaft is rotated in the stationary cylinder, a rotary compressor disclosed in Japanese Patent Publication Nos. 62-284985 and 64-100291 includes: a stationary shaft having a shaft and a piston portion which are integrally formed, the shaft having an inlet port in the shaft line direction, the piston portion being eccentric at a larger diameter than that of the shaft and having a port in the radial direction to communicate with the inlet port of the shaft; a protruding vane; a rotor which is rotatable with the vane accommodated therein; an upper bearing having an outlet port; a lower bearing; a permanent magnet formed in a hollow cylindrical shape with a height greater than a difference between an outer diameter and an inner diameter and fixed to the lower bearing; and a coil which is not rotated on the outer circumference of the permanent magnet. The upper bearing, the rotor and the lower bearing are rotatably connected in order, and the vane encloses the space between the rotor and the upper bearing and the lower bearing and the piston portion. There is a change in volume.

In the rotary compressor disclosed in the above Japanese Patent Publications, the hollow cylindrical permanent magnet is located inside the stator, and the rotor including the vane and the compression mechanism unit are located inside the permanent magnet. Accordingly, this rotary compressor is considered to solve the problem of the conventional rotary compressor generated because the motor unit and the compression mechanism unit are installed in the height direction.

However, in the rotary compressor disclosed in the above Japanese Patent Publications, the vane is elastically supported on the rotating rotor and is in sliding-contact with an outer surface of the stationary eccentric portion (piston portion). Like the conventional rotary compressor, a large relative velocity difference is present between the vane and the eccentric portion (piston portion), which generates a friction loss, and a refrigerant leakage probability is still present on a sliding-contact surface between the vane and the eccentric portion. Moreover, the rotary compressor disclosed in the above Japanese Patent Publications does not suggest any realizable structure for suction and discharge passages of a working fluid, lubrication oil feeding in the compression mechanism unit, or mounting of a bearing member, and thus does not reach the stage of practical application.

Meanwhile, U.S. Pat. No. 7,217,110 discloses a rotary compressor in which a stationary shaft and an eccentric portion are integrally formed and a compression space is defined between an outer surface of a roller rotatably located on the eccentric portion and an inner surface of a rotating rotor. Here, a rotation force of the rotor is transferred to the roller through a vane fixed to upper and lower plates of the rotor and integrally rotated with the rotor, and a working fluid and lubrication oil are introduced into the compression space through a longitudinal passage formed in the center of the stationary shaft using a difference between an inner pressure of a hermetic container and an inner pressure of the compression space.

Also in the rotary compressor disclosed in the above U.S. Patent Publication, a compression mechanism unit is formed inside the rotor. Accordingly, this rotary compressor is considered to solve the problem of the conventional rotary compressor generated because the motor unit and the compression mechanism unit are installed in the height direction. Further, unlike the Japanese patent publications, the rotor, the vane and the roller are integrally rotated, and thus do not have a relative velocity difference, thus preventing a friction loss.

However, in the rotary compressor disclosed in the above U.S. Patent Publication, one end portion of the stationary shaft is fixed to the hermetic container, but the other end thereof is spaced apart from the hermetic container and suspended on the hermetic container. It is thus difficult to center the stationary shaft. There are other problems such as weakness to the horizontal direction vibration caused by the eccentric rotation which is an inevitable characteristic of the rotary compressor, difficulty in manufacturing, or degradation of assembly productivity. Additionally, since the vane inwardly protrudes from the rotor and a vane groove is formed in the roller to guide a traveling track of the vane, the volume of the roller is inevitably increased to form the vane groove. The roller of a relatively large volume excites the horizontal direction vibration by the eccentric rotation. A structure not using the lubrication oil has also been disclosed. For this purpose, components should be formed of very expensive materials. With respect to a structure using the lubrication oil, the lubrication oil is lifted into the compression space using a difference between an inner pressure of the hermetic container and an inner pressure of the compression space and circulated with a working fluid. In this situation, a lot of lubrication oil may be inevitably incorporated in the working fluid and discharged from the compressor with the working fluid, which degrades the lubrication performance.

DISCLOSURE

Technical Problem

The present invention has been made in an effort to solve the above-described problems of the prior art, and an object of the present invention is to provide a compressor in which components can be easily centered and assembled in a hermetic container, thus improving the structural safety.

Another object of the present invention is to provide a compressor which can reduce the horizontal direction vibration caused by the eccentric rotation, improve efficiency, and simplify the actual production assembly.

A further object of the present invention is to provide a compressor in which a rotary member can be smoothly rotated, although it is suspended on a stationary member.

A still further object of the present invention is to provide a compressor which can reduce the vibration by improving a vane mounting structure.

A still further object of the present invention is to provide a compressor in which a vane can be easily lubricated.

A still further object of the present invention is to provide a compressor which can lower the product height and effectively perform the suction and discharge of the refrigerant.

A still further object of the present invention is to provide a compressor which can reduce the noise generated by the suction and discharge of the refrigerant.

A still further object of the present invention is to provide a compressor in which the oil stored in a hermetic container can be supplied to a lubrication passage between a stationary member and a rotary member.

Technical Solution

According to an aspect of the present invention for achieving the above objects, there is provided a compressor, including: a hermetic container into/from which the refrigerant is sucked and discharged; a stator fixed in the hermetic container; a stationary member including a stationary shaft formed in a cylindrical shape and having both ends immovably installed in the hermetic container, and an eccentric portion formed in a cylindrical shape with a larger diameter than that of the cylinder of the stationary shaft, protruding from the stationary shaft in the entire radial direction of the stationary shaft, and eccentrically formed on the stationary shaft; a rotary member including a cylinder-type rotor rotated around the stationary shaft by a rotating electromagnetic field from the stator, a roller applied with a rotation force of the cylinder-type rotor, rotated around the eccentric portion with the cylinder-type rotor, and defining a compression space between the roller and the cylinder-type rotor, and a vane transferring the rotation force from the cylinder-type rotor to the roller and partitioning the compression space into a suction pocket into which the refrigerant is sucked and a compression pocket in/from which the refrigerant is compressed and discharged, the cylinder-type rotor and the roller being rotated together such that the opposite portions are repeatedly brought into close and distant positions; and upper and lower bearing covers forming upper and lower portions of the rotary member, rotated with the rotary member, rotatably supporting the rotary member with respect to the stationary member, and defining a compression space in the rotary member, wherein inner circumferential surfaces of the upper and lower bearing covers are rotatably journal-supported on the stationary shaft, and a bottom surface of the upper bearing cover is rotatably thrust-supported on a top surface of the eccentric portion.

In addition, the compressor further includes an upper shaft holder for fixing a top end of the stationary shaft to an upper portion of the hermetic container, and a lower shaft holder for fixing a bottom end of the stationary shaft to a lower portion of the hermetic container.

Moreover, a lower shaft holder-side end portion of the lower bearing cover rotatably journal-supported on the stationary shaft is rotatably thrust-supported on a top surface of the lower shaft holder.

Further, the vane is fixedly formed on the roller to protrude from an outer circumferential surface of the roller to the cylinder-type rotor, and a vane mounting hole is formed in the cylinder-type rotor to accommodate the protruding vane.

Furthermore, the cylinder-type rotor includes a cylinder defining a compression space between the rotor and the roller, and a rotor formed by staking iron pieces in the axial direction such that permanent magnets are inserted into a plurality of holes formed in the stacked body to face the stator, the cylinder and the rotor being die-matched with each other.

Still furthermore, the cylinder-type rotor is integrally formed by powder sintering such that permanent magnets are inserted into a plurality of holes formed in the powder-sintered body to face the stator.

Still furthermore, the cylinder-type rotor is formed by staking iron pieces in the axial direction such that permanent magnets are inserted into a plurality of holes formed in the stacked body to face the stator, an inner surface of the stacked body forming an inner surface of the cylinder.

Still furthermore, the compressor includes: an inlet port formed in either the upper or lower bearing cover to enable the refrigerant to be sucked into the compression space; and a refrigerant suction passage communicating with an inner space of the hermetic container to enable the low-pressure refrigerant in the inner space to be sucked into the compression space through the inlet port.

Still furthermore, at least a part of the stationary shaft is formed as a hollow shaft to communicate with the outside of the hermetic container, wherein the compressor includes: an outlet port formed in either the upper or lower bearing cover to discharge the refrigerant compressed in the compression space; and a refrigerant discharge passage isolating the compression refrigerant discharged through the outlet port from the inner space of the hermetic container and discharging the refrigerant to the outside of the hermetic container through the hollow space of the stationary shaft.

Still furthermore, the muffler is rotatably supported with respect to the stationary shaft to form a discharge chamber for a noise space of the compression refrigerant discharged through the outlet port in the bearing cover with the outlet port therein, and the refrigerant discharge passage further includes a discharge guide passage for guiding the compression refrigerant from the discharge chamber to the hollow space of the stationary shaft.

Still furthermore, the inlet port and the outlet port are formed in the upper bearing cover, the low-pressure refrigerant is sucked into the compression space through the inlet port formed in the muffler, the suction chamber formed between the muffler and the upper bearing cover, and the inlet port of the upper bearing cover, and the compression refrigerant is guided to the hollow space of the stationary shaft through the outlet port of the upper bearing cover, the discharge chamber formed between the muffler and the upper bearing cover and isolated from the suction chamber, a first discharge guide passage penetrating through a shaft portion of the upper bearing cover enclosing an upper portion of the stationary shaft, a second discharge guide passage formed in an annular shape between an inner circumferential surface of the shaft portion of the upper bearing cover and an outer circumferential surface of the upper portion of the stationary shaft to communicate with the first discharge guide passage, and a third discharge guide passage formed to enable the second discharge guide passage and the hollow space of the upper portion of the stationary shaft to communicate with each other, and discharged to the outside of the hermetic container.

Still furthermore, the compressor includes a lower lubrication passage provided between the stationary shaft and the eccentric portion, and the roller to supply the oil stored in the hermetic container to between the eccentric portion and the roller.

Still furthermore, a groove is formed along an inner circumferential surface of the lower bearing cover to supply oil although an inner circumferential surface of the lower bearing cover is in contact with an outer circumferential surface of a bottom end of the stationary shaft, and the groove of the lower bearing cover communicates with the lower lubrication passage.

Still furthermore, the vane is integrally formed with the roller to protrude from an outer circumferential surface of the roller to the cylinder-type rotor, a vane mounting hole is formed in the cylinder-type rotor to accommodate the protruding vane, and at least a part of the bottommost end of the vane mounting hole is open to communicate with the oil stored in the hermetic container.

Still furthermore, the compressor includes an upper lubrication passage provided between the stationary shaft and the eccentric portion, and the upper bearing cover to separate the oil compressed in the compression space with the refrigerant and supply the oil to between the eccentric portion and the upper bearing cover.

Advantageous Effects

In the compressor according to the present invention, the rotary member is suspended on the stationary member, and the top and bottom ends of the stationary shaft of the stationary member are immovably fixed to the hermetic container. The components can be easily centered and assembled in the hermetic container, which leads to high structural safety and easy assembly.

Additionally, in the compressor according to the present invention, although the eccentric portion is eccentric from the center of the stationary shaft, it protrudes in the entire radial direction of the stationary shaft and maintains a still state. When the cylinder-type rotor is rotated around the stationary shaft, the roller is rotated around the eccentric portion. As the cylinder-type rotor and the roller are rotated around the respective shafts, the eccentric rotation does not occur. As a result, it is possible to reduce the horizontal direction vibration caused by the eccentric rotation and omit the balance weight for reducing the vibration caused by the eccentric rotation, thereby improving efficiency and simplifying the actual production assembly.

Moreover, in the compressor according to the present invention, although the rotary member is suspended on the stationary member, the bearing covers and the lubrication passage are provided on the thrust surfaces and the journal surfaces brought into contact with each other. Even if the rotary member is in contact with the stationary member, it can be smoothly rotated and stably operated. This reduces a friction loss to improve the compression efficiency.

In addition, in the compressor according to the present invention, the vane is integrally formed with the outer circumferential surface of the roller and fitted into the vane mounting hole provided in the inner circumferential surface of the cylinder-type rotor. This prevents the excessive size increase of the roller and the vibration caused by the eccentric rotation of the roller, which are generated because the vane mounting hole is provided in the roller. As the vane mounting hole is provided in the cylinder-type rotor having a larger volume than that of the roller, there is an advantage such as simplification of the actual production assembly.

Further, in the compressor according to the present invention, although the vane mounting hole is provided in the cylinder-type rotor and the lower bearing cover is mounted at the lower portion of the cylinder-type rotor, the lower bearing cover is installed without covering a part of the vane mounting hole. Therefore, the oil stored in the hermetic container is introduced directly into the vane mounting hole of the cylinder-type rotor. This facilitates the lubrication to improve the operation reliability.

Furthermore, in the compressor according to the present invention, although the rotary member is suspended on the outer circumferential surface of the stationary member, since the inlet port and the outlet port are formed in the bearing cover of the rotary member coupled in the axial direction, the rotary member is provided on the outer circumference of the stationary member. Even if the compressor has a reduced height, it can effectively perform the suction and discharge of the refrigerant.

Still furthermore, in the compressor according to the present invention, the suction chamber and the discharge chamber are formed between the bearing cover of the rotary member coupled in the axial direction and the muffler. The refrigerant passes through the suction chamber before being sucked into the compression chamber, and the refrigerant discharged from the compression space passes through the discharge chamber. This reduces the noise caused by the refrigerant flow and the noise caused by the opening and closing of the valve.

Still furthermore, in the compressor according to the present invention, the oil stored in the hermetic compressor is supplied through the communicating passage to lubricate between the stationary shaft and the lower bearing cover, between the eccentric portion and the roller, and between the eccentric portion and the lower bearing cover, and compressed in and discharged from the compression space with the refrigerant to lubricate between the stationary shaft and the upper bearing cover and between the eccentric portion and the upper bearing cover. It is possible to omit an oil pumping member and reduce a friction loss between the components, thereby improving the compression efficiency and the operation reliability.

BEST MODE FOR CARRYING OUT INVENTION

Figure 1:
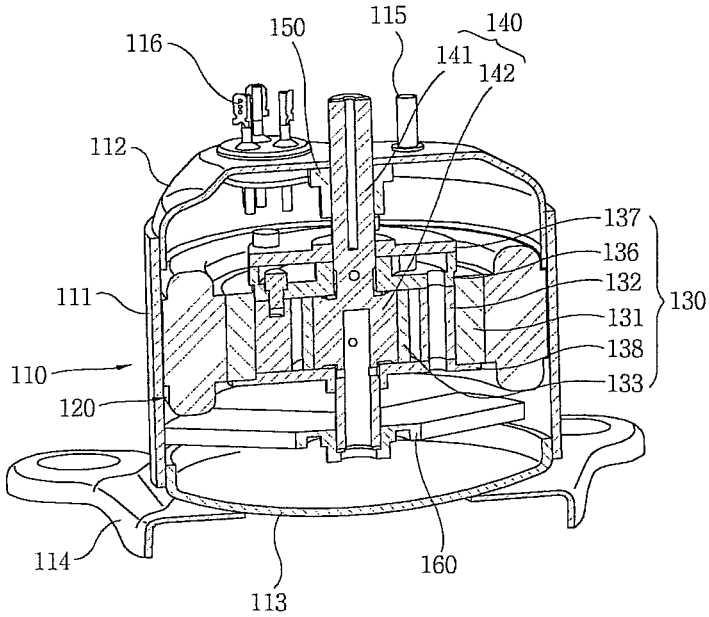
FIG. 1 is a side-sectional view of an embodiment of a compressor according to the present invention.
Figure 2:
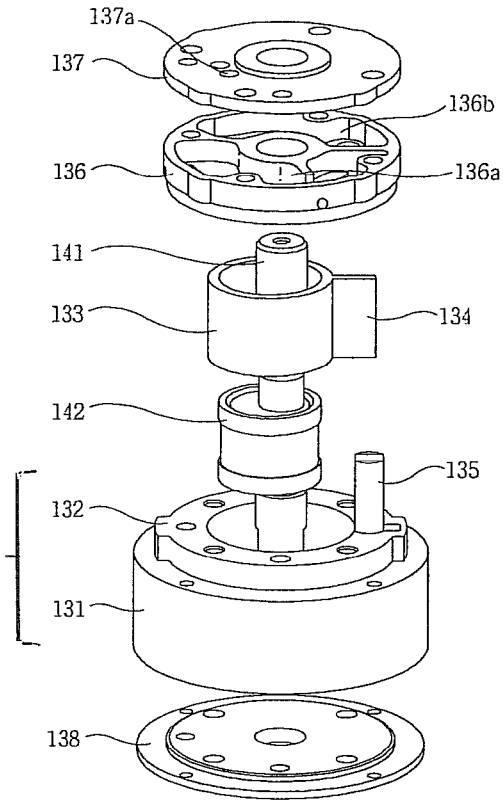
FIG. 2 is an exploded perspective view of the embodiment of the compressor according to the present invention.

FIGS. 1 and 2 are views of an embodiment of a compressor according to the present invention.

As illustrated in FIGS. 1 and 2, the embodiment of the compressor according to the present invention includes a hermetic container 110, a stator 120 fixed in the hermetic container 110, a rotary member 130 installed inside the stator 120 to be rotated by a rotating electromagnetic field from the stator 120 and compressing the refrigerant, and a stationary member 140, the rotary member 130 being suspended on its outer circumferential surface, top and bottom ends of a stationary shaft 141 being immovably fixed to the hermetic container 110. Here, a motor mechanism unit supplying power through an electrical action includes the stator 120 and a rotor 131 of the rotary member 130. A compression mechanism unit compressing the refrigerant through a mechanical action includes the rotary member 130 and the stationary member 140. Therefore, the motor mechanism unit and the compression mechanism unit are installed in the radial direction, which reduces the overall height of the compressor.

The hermetic container 110 includes a cylindrical body portion 111, upper and lower shells 112 and 113 coupled to upper and lower portions of the body portion 111, and a mounting portion 114 provided on a bottom surface of the lower shell 113 in the radial direction to fixedly fasten the hermetic container 110 to another product. The oil lubricating the rotary member 130 and the stationary member 140 can be stored in the hermetic container 110 at a proper height. A suction pipe 115 through which the refrigerant can be sucked is provided in a given position of the upper shell 112, and the stationary shaft 141 is provided in the center of the upper shell 112 to be exposed therefrom, which is an example of a discharge pipe (not shown) through which the refrigerant is discharged. The compressor is determined as a high-pressure type or a low-pressure type according to whether the hermetic container 110 is filled with the compression refrigerant or pre-compression refrigerant. As such, the suction pipe and the discharge pipe may be reversed. In the embodiment of the present invention, the compressor is a low-pressure type and the stationary shaft 141 which is the discharge pipe is provided to protrude to the outside of the hermetic container 110. However, there is no need that the stationary shaft 141 should excessively protrude to the outside of the hermetic container 110. Preferably, an appropriate fixing structure is installed on the outside of the hermetic container 110 and connected to an external refrigerant pipe. Additionally, a terminal 116 supplying power to the stator 120 is provided on the upper shell 112.

The stator 120 includes a core and a coil intensively wound on the core and is fixed to the inside of the body portion 111 of the hermetic container 110 by shrinkage fitting. A core employed in a general BLDC motor has 9 slots along the circumference. In the preferred embodiment of the present invention, the diameter of the stator 120 is relatively increased such that the core of the BLDC motor has 12 slots along the circumference. The more the slots of the core, the larger the winding number of the coil. Even if the height of the core is reduced, it is possible to produce an electromagnetic force of a general stator.

The rotary member 130 includes a cylinder-type rotor 131 and 132, a roller 133, a vane 134, a bushing 135, an upper bearing cover 136 and a muffler 137, and a lower bearing cover 138. The cylinder-type rotor 131 and 132 includes a rotor 131 having a plurality of permanent magnets in the axial direction to be rotated by the rotating electromagnetic field from the stator 120, and a cylinder 132 located inside the rotor 131, integrally rotated with the rotor 131 and having a compression space therein. The rotor 131 and the cylinder 132 may be separately formed and die-matched or integrally formed in the form of a powder-sintered body or an iron piece-stacked body. The roller 133 is formed in a cylindrical shape and rotatably mounted on an outer circumferential surface of an eccentric portion 142 of the stationary member 140 explained below. For this purpose, it is preferable to apply a lubrication structure to between the roller 133 and the eccentric portion 142. The vane 134 is integrally formed on an outer circumferential surface of the roller 133 to expand in the radial direction, and fitted into a vane mounting hole 132H provided in an inner circumferential surface of the cylinder-type rotor 131 and 132 or the cylinder 132. The bushings 135 are installed to support both sides of an end portion of the vane 134 fitted into the vane mounting hole 132H of the cylinder-type rotor 131 and 132. A lubrication structure is applied such that the vane 134 is smoothly moved between the vane mounting hole 132H of the cylinder-type rotor 131 and 132 and the bushings 135.

The upper bearing cover 136 and the muffler 137, and the lower bearing cover 138 are coupled to the cylinder-type rotor 131 and 132 in the axial direction, define a compression space between the cylinder-type rotor 131 and 132, and the roller 133 and the vane 134, and are in journal-bearing or thrust-bearing contact with the stationary member 140. A space between a top surface of the upper bearing cover 136 and the muffler 137 is partitioned into a suction chamber 136*a* and a discharge chamber 136*b*. The suction chamber 136*a* communicates with inlet ports (not shown, 137*a*) provided in the upper bearing cover 136 and the muffler 137, and the discharge chamber 136*b* communicates with an outlet port (not shown) provided in the upper bearing cover 136 and a discharge guide passage (not shown) provided in a shaft portion upwardly protruding from the center of the upper bearing cover 136. A suction valve or a discharge valve may be provided on the inlet port and the outlet port provided in the upper bearing cover 136. Preferably, the inlet port and the outlet port provided in the upper bearing cover 136 are provided on both sides of the vane 134 to be separated by the vane 134. The upper bearing cover 136 and the muffler 137 are coupled to a top surface of the cylinder-type rotor 131 and 132, and the lower bearing cover 138 is coupled to a bottom surface of the cylinder-type rotor 131 and 132. They are fastened to the cylinder-type rotor 131 and 132 at a time by a fastening member such as a long bolt, etc.

The stationary member 140 includes the stationary shaft 141 formed in a cylindrical shape, and the eccentric portion 142 protruding from the stationary shaft 141 in the entire radial direction of the stationary shaft 141 to have a cylindrical shape of a greater diameter than that of the cylinder of the stationary shaft 141 and eccentrically formed on the stationary shaft 141. An oil supply passage 141A through which the oil stored in the hermetic container 110 can be supplied is formed at a lower portion of the stationary shaft 141, and a refrigerant discharge passage 141B through which the high-pressure refrigerant can be discharged is formed at an upper portion of the stationary shaft 141. The oil supply passage 141A and the refrigerant discharge passage 141B are isolated from each other, which prevents the oil from being discharged with the refrigerant. The eccentric portion 142 is expanded in the entire radial direction of the stationary shaft 141. Since top and bottom surfaces of the eccentric portion 142 are brought into contact with the upper and lower bearing covers 136 and 138 and operated as thrust surfaces, it is preferable to form a lubrication oil supply passage on the top and bottom surfaces of the eccentric portion 142, and since the roller 133 is rotatably installed in contact with an outer circumferential surface of the eccentric portion 142, it is preferable to form a lubrication oil supply passage inside the eccentric portion 142 to extend to the outer circumferential surface thereof.

Moreover, upper and lower shaft holders 150 and 160 are provided to fix the stationary shaft 141 to the hermetic container 110. The upper shaft holder 150 is fixed to the upper shell 112 of the hermetic container 110 by welding or the like after an upper portion of the stationary shaft 141 is fitted thereto. The lower shaft holder 160 is fixed to a side surface of the body portion 111 of the hermetic container 110 by shrinkage fitting or 3-point welding after a lower portion of the stationary shaft 141 is fitted thereto. The upper shaft holder 150 is smaller than the lower shaft holder 160 in the radial direction. The reason for this is to prevent the interference with the suction pipe 115 or the terminal 116 provided on the upper shell 112. The upper and lower shaft holders 150 and 160 are manufactured by press working, but the roller 133 and the vane 134, the bushing 135, the upper and lower bearing covers 136 and 138, and the stationary shaft 141 and the eccentric portion 142 are manufactured by casting using cast iron, grinding and additional machining.

Figure 3:
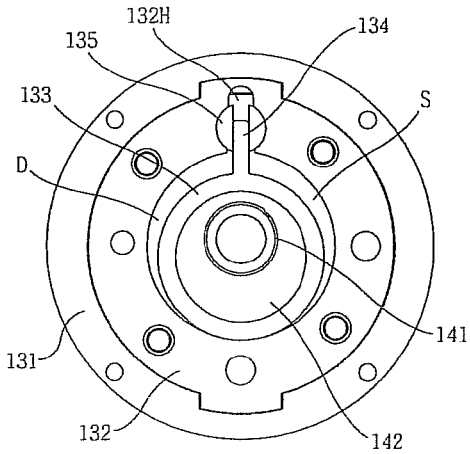
FIG. 3 is a plan view of a vane mounting structure of the compressor according to the present invention.
Figure 4:
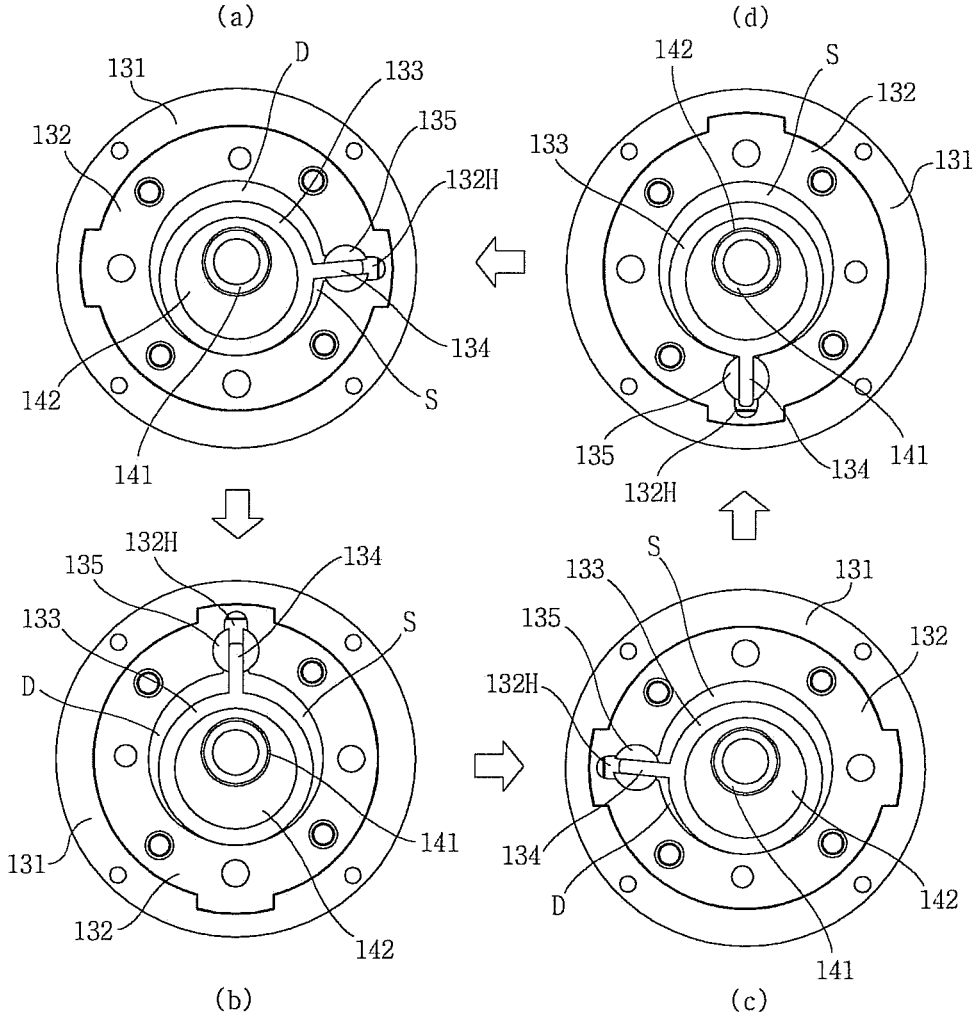
FIG. 4 is a plan view of an operation cycle of a compression mechanism unit of the compressor according to the present invention.

FIG. 3 is a plan view of a vane mounting structure of the compressor according to the present invention, and FIG. 4 is a plan view of an operation cycle of the compression mechanism unit of the compressor according to the present invention.

The mounting structure of the vane 134 will be described with reference to FIG. 3. The vane mounting hole 132H is formed in an inner circumferential surface of the cylinder-type rotor 131 and 132 to be elongated in the radial direction and penetrated in the axial direction, the pair of bushings 135 are fitted into the vane mounting hole 132H, and the vane 134 integrally formed on an outer circumferential surface of the roller 133 is fitted between the bushings 135. Here, a compression space is defined between the cylinder-type rotor 131 and 132 and the roller 133 and divided into a suction pocket S and a compression pocket D by the vane 134. The inlet port and the suction chamber 136*a* (see FIG. 2) of the upper bearing cover 136 (see FIG. 2) described above are located to communicate with the suction pocket S, and the outlet port and the discharge chamber 136*b* (see FIG. 2) of the upper bearing cover 136 (see FIG. 2) are located to communicate with the compression pocket D. Preferably, they are located adjacent to the vane 134 to reduce a dead volume. In the compressor of the present invention, the vane 134 integrally formed with the roller 133 is slidably assembled between the bushings 135. This can prevent a friction loss caused by sliding-contact generated in the conventional rotary compressor in which the vane separately formed from the roller or the cylinder is supported by the spring and reduce refrigerant leakage between the suction pocket S and the compression pocket D.

Accordingly, when the cylinder-type rotor 131 and 132 is applied with a rotation force by a rotating magnetic field between the rotor and the stator 120 (see FIG. 1), it is rotated. In a state where the vane 134 is fitted into the vane mounting hole 132H of the cylinder-type rotor 131 and 132, it transfers the rotation force of the cylinder-type rotor 131 and 132 to the roller 133. Here, the vane 134 is linearly reciprocated between the bushings 135 due to the rotation of the rotor and the roller. That is, an inner circumferential surface of the cylinder-type rotor 131 and 132 and an outer circumferential surface of the rotor 133 have corresponding portions. In every rotation of the cylinder-type rotor 131 and 132 and the roller 133, the corresponding portions are repeatedly brought into contact and distant positions. Therefore, the suction pocket S is gradually increased such that the refrigerant or working fluid is sucked into the suction pocket S, and the compression pocket D is gradually decreased such that the refrigerant or working fluid therein is compressed and discharged.

The suction, compression and discharge process of the compression mechanism unit will be described. As illustrated in FIG. 4, the cylinder-type rotor 131 and 132 and the roller 133 are rotated and their relative positions are changed to (a), (b), (c) and (d) during one cycle. In more detail, when the cylinder-type rotor 131 and 132 and the roller 133 are located in (a), the refrigerant or working fluid is sucked into the suction pocket S and compressed in the compression pocket D separated from the suction pocket S by the vane 134. When the cylinder-type rotor 131 and 132 and the roller 133 are rotated to reach (b), the suction pocket S is increased and the compression pocket D is decreased such that the refrigerant or working fluid is sucked into the suction pocket S and compressed in the compression pocket D. When the cylinder-type rotor 131 and 132 and the roller 133 are rotated to reach (c), the refrigerant or working fluid is continuously sucked into the suction pocket S. If the refrigerant or working fluid has a pressure over a set pressure in the compression pocket D, it is discharged through the outlet port and the discharge valve of the upper bearing cover 136 (see FIG. 2). The suction and discharge of the refrigerant or working fluid are almost done in (d).

Figure 5:
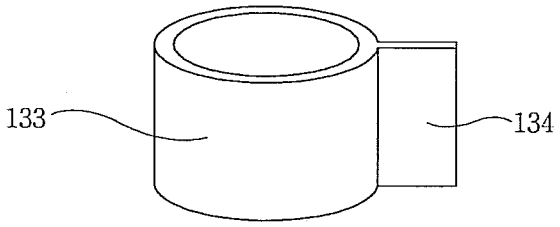
FIG. 5 is a perspective view of an example of a vane-incorporated roller of the compressor according to the present invention.

FIG. 5 is a perspective view of an example of the vane-incorporated roller of the compressor according to the present invention.

As illustrated in FIG. 5, the vane-incorporated roller 133 and 134 includes the cylindrical roller 133 and the vane 134 extending from an outer circumferential surface of the roller 133 in the radial direction. The vane-incorporated roller 133 and 134 is manufactured by casting using cast iron, grinding and additional machining. As explained above, an inner diameter of the roller 133 has an allowance of about 20 to 30 μm from an outer diameter of the eccentric portion 142 (see FIG. 2) such that the roller 133 is rotatably mounted on an outer circumferential surface of the eccentric portion 142 (see FIG. 2). Since the lubricating oil supply passage is provided on the outer circumferential surface of the eccentric portion 142 (see FIG. 2) or the inner circumferential surface of the roller 133, a loss caused by sliding-contact is seldom generated between the roller 133 and the eccentric portion 142 (see FIG. 2). As compared with the conventional rotary compressor in which the vane is elastically supported on the cylinder and brought into sliding-contact with the roller, the rotary compressor in which the roller 133 and the vane 134 are integrally formed removes the sliding loss to thereby improve the operation efficiency and prevents the refrigerant of the suction pocket S (see FIG. 4) and the refrigerant of the compression pocket D (see FIG. 4) from being mixed between the roller 133 and the vane 134.

Figure 6:
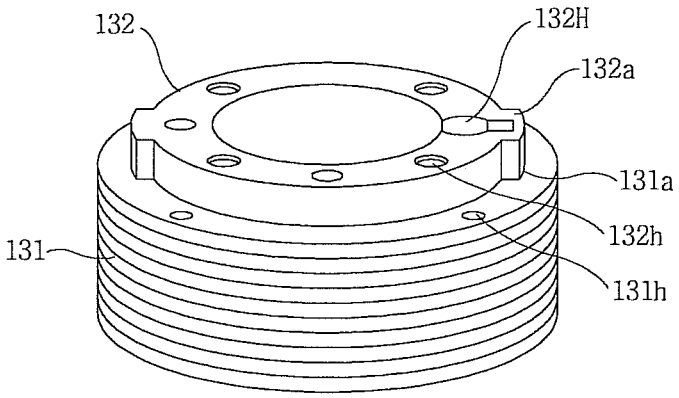
FIGS. 6 to 8 are perspective views of various embodiments of a cylinder-type rotor of the compressor according to the present invention.
Figure 7:
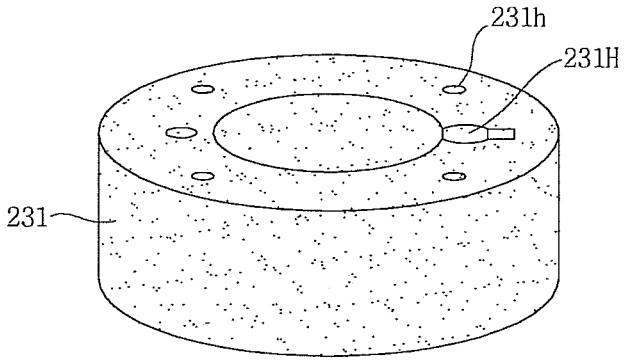
Figure 8:
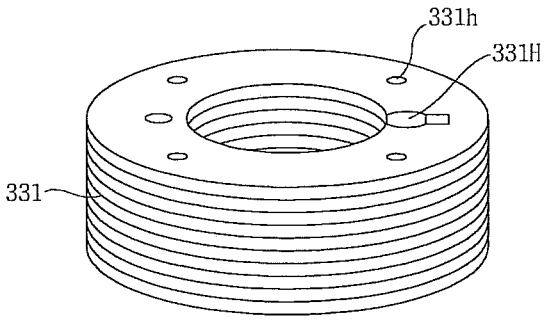

FIGS. 6 to 8 are perspective views of various embodiments of the cylinder-type rotor of the compressor according to the present invention.

As illustrated in FIG. 6, in a first embodiment of the cylinder-type rotor 131 and 132, the rotor 131 and the cylinder 132 are separately formed of different materials. An outer circumferential surface of the cylinder 132 is die-matched with an inner circumferential surface of the rotor 131 such that the rotor 131 and the cylinder 132 are integrally rotated. The rotor 131 is formed by stacking iron pieces in the axial direction such that permanent magnets (not shown) are inserted into a plurality of holes formed in the stacked body to face the stator 120 (see FIG. 2). A compression space is defined between the cylinder 132 and the roller 133 (see FIG. 2). A plurality of coupling grooves 131*a* are provided in the inner circumferential surface of the rotor 131 to die-match the rotor 131 with the cylinder 132, and a plurality of coupling protrusions 132*a* are provided on the outer circumferential surface of the cylinder 132 to be die-matched with the coupling grooves 131*a* of the rotor 131. The cylinder 132 is formed in a cylindrical shape with a constant thickness in the radial direction, but has a larger thickness in the radial direction in the regions of the coupling protrusions 132*a*. Accordingly, preferably, the vane mounting hole 132H provided in the inner circumferential surface of the cylinder 132 is formed in a position corresponding to one of the coupling protrusions 132*a* of the cylinder 132 for better space utilization. Meanwhile, as the rotor 131 and the cylinder 132 are separately formed, the upper bearing cover 136 and the muffler 137 are bolt-fastened to either the rotor 131 or the cylinder 132 and the lower bearing cover 138 is bolt-fastened to the other, thereby obtaining a stably-fixed structure. Therefore, for the fastening of the upper bearing cover 136 (see FIG. 2) and the muffler 137 (see FIG. 2), and the lower bearing cover 138 (see FIG. 2), a plurality of bolt holes 131*h* and 132*h* are preferably formed in the rotor 131 and the cylinder 132 at regular intervals in the circumferential direction. Although the rotor 131 and the cylinder 132 are separately formed, they are integrally rotated. As such, the upper bearing cover 136 (see FIG. 2) and the muffler 137 (see FIG. 2), and the lower bearing cover 138 (see FIG. 2) may be bolt-fastened only to the cylinder 132.

In the first embodiment of the cylinder-type rotor, two coupling grooves 131*a* of the rotor 131 are located in the opposite directions, two coupling protrusions 132*a* of the cylinder 132 are located in the opposite directions, and the vane mounting hole 132H is formed in a position corresponding to either one of them. In addition, four bolt holes 131*h* and 132*h* are provided in the rotor 131 and the cylinder 132 at regular intervals in the circumferential direction such that the upper bearing cover 136 and the muffler 137, and the lower bearing cover 138 are separately fastened to the rotor 131 and the cylinder 132.

As illustrated in FIG. 7, a second embodiment of the cylinder-type rotor is integrally formed by powder sintering such that permanent magnets are inserted into a plurality of holes formed in the powder-sintered body to face the stator 120 (see FIG. 2). An outer circumferential surface provided with the permanent magnets may be considered as a rotor portion and an inner circumferential surface provided inside the rotor portion may be considered as a cylinder portion. A vane mounting hole 231H is provided in the inner circumferential surface of the cylinder-type rotor 231, and a plurality of bolt holes 231*h* are provided in the cylinder-type rotor 231 at regular intervals in the circumferential direction such that the upper bearing cover 136 (see FIG. 2) and the muffler 137 (see FIG. 2), and the lower bearing cover 138 (see FIG. 2) are bolt-fastened thereto. Since the cylinder-type rotor 231 is manufactured by powder sintering, the holes with the permanent magnets mounted thereon, the vane mounting hole 231H and the bolt holes 231*h* are formed during the powder sintering.

As illustrated in FIG. 8, a third embodiment of the cylinder-type rotor is formed by stacking iron pieces in the axial direction such that permanent magnets (not shown) are inserted into a plurality of holes formed in the stacked body to face the stator 120 (see FIG. 2). An outer circumferential surface provided with the permanent magnets may be considered as a rotor portion and an inner circumferential surface provided inside the rotor portion may be considered as a cylinder portion. Moreover, a vane mounting hole 331H is provided in the inner circumferential surface of the cylinder-type rotor 331, and a plurality of bolt holes 331*h* are provided in the cylinder-type rotor 331 at regular intervals in the circumferential direction such that the upper bearing cover 136 (see FIG. 2) and the muffler 137 (see FIG. 2), and the lower bearing cover 138 (see FIG. 2) are bolt-fastened thereto. Since the cylinder-type rotor 331 is manufactured by stacking the iron pieces, the holes with the permanent magnets mounted thereon, the vane mounting hole 331H and the bolt holes 331*h* are provided in the respective iron pieces. When these iron pieces are stacked in the axial direction, the series of holes penetrated in the axial direction, the vane mounting hole 331H and the bolt holes 331*h* are formed.

Figure 9:
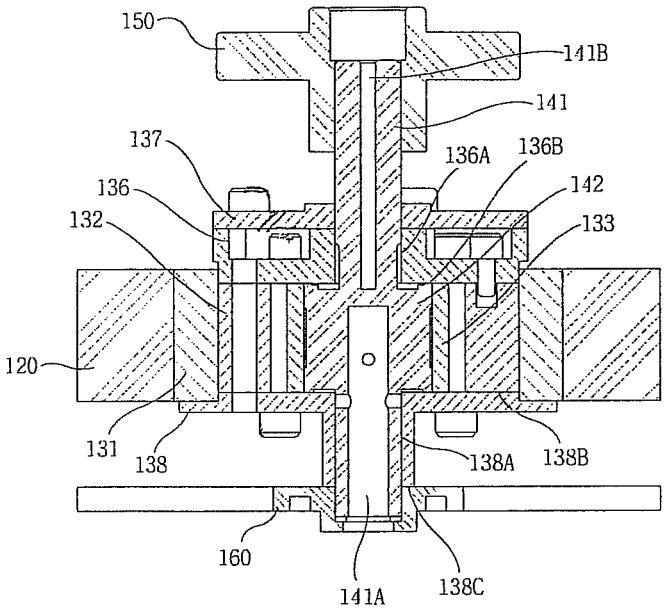
FIG. 9 is a perspective view of an upper and lower bearing cover mounting structure of the compressor according to the present invention.

FIG. 9 is a perspective view of an upper and lower bearing cover mounting structure of the compressor according to the present invention.

As illustrated in FIG. 9, the upper and lower bearing covers 136 and 138 include a shaft portion enclosing the stationary shaft 141 and a cover portion brought into contact with the eccentric portion 142. Bearings are provided on their journal and thrust surfaces brought into contact with the stationary shaft 141 and the eccentric portion 142. Here, a first journal bearing 136A is provided on an inner circumferential surface of the shaft portion of the upper bearing cover 136 enclosing an upper portion of the stationary shaft 141 and a first thrust bearing 136B is provided on a bottom surface of the plate of the upper bearing cover 136 coupled to a top surface of the eccentric portion 142. As the rotary member 130 (see FIG. 1) is installed to be suspended on the stationary member 140 (see FIG. 1), the upper bearing cover 136 and the eccentric portion 142 have a relatively large contact area. Thus, the first thrust bearing 136B should be essentially provided. Additionally, a second journal bearing 138A is provided on an inner circumferential surface of the shaft portion of the lower bearing cover 138 enclosing a lower portion of the stationary shaft 141 and a second thrust bearing 138B is provided on a top surface of the plate of the lower bearing cover 138 coupled to a bottom surface of the eccentric portion 142. Here, the shaft portion of the lower bearing cover 138 needs not to extend to the lower shaft holder 160. However, when the shaft portion of the lower bearing cover 138 is extended to and supported by the lower shaft holder 160, it is possible to obtain a stable structure. Preferably, a bottom surface of the shaft portion of the lower bearing cover 138 is thrust-bearing supported on a top surface of the lower shaft holder 160. For example, a third thrust bearing 138C may be provided on the bottom surface of the shaft portion of the lower bearing cover 138, or a plate-shaped bearing may be provided on a groove formed in the top surface of the lower shaft holder 160 on which the shaft portion of the lower bearing cover 138 is seated.

The upper and lower bearing covers 136 and 138 described above are fitted onto upper and lower portions of the stationary shaft 141 in the axial direction, and then bolt-fastened to the rotor 131 (see FIG. 2) or the cylinder 132, respectively. As set forth herein, if the cylinder-type rotor in which the rotor 131 (see FIG. 2) and the cylinder 132 are integrally formed is employed, the upper and lower bearing covers 136 and 138 are bolt-fastened to the cylinder-type rotor at a time. Meanwhile, if the cylinder-type rotor in which the rotor 131 (see FIG. 2) and the cylinder 132 are separately formed is employed, the upper and lower bearing covers 136 and 138 may be bolt-fastened to the rotor 131 (see FIG. 2) and the cylinder 132, respectively, or bolt-fastened only to the cylinder 132. In the embodiment of the present invention, the cylinder-type rotor in which the rotor 131 (see FIG. 2) and the cylinder 132 are separately formed is employed, and the upper bearing cover 136 and the muffler 137, and the lower bearing cover 138 are bolt-fastened to the cylinder 132, respectively. The lubrication structure described below serves to lubricate the upper and lower bearing covers 136 and 138.

Figure 10:
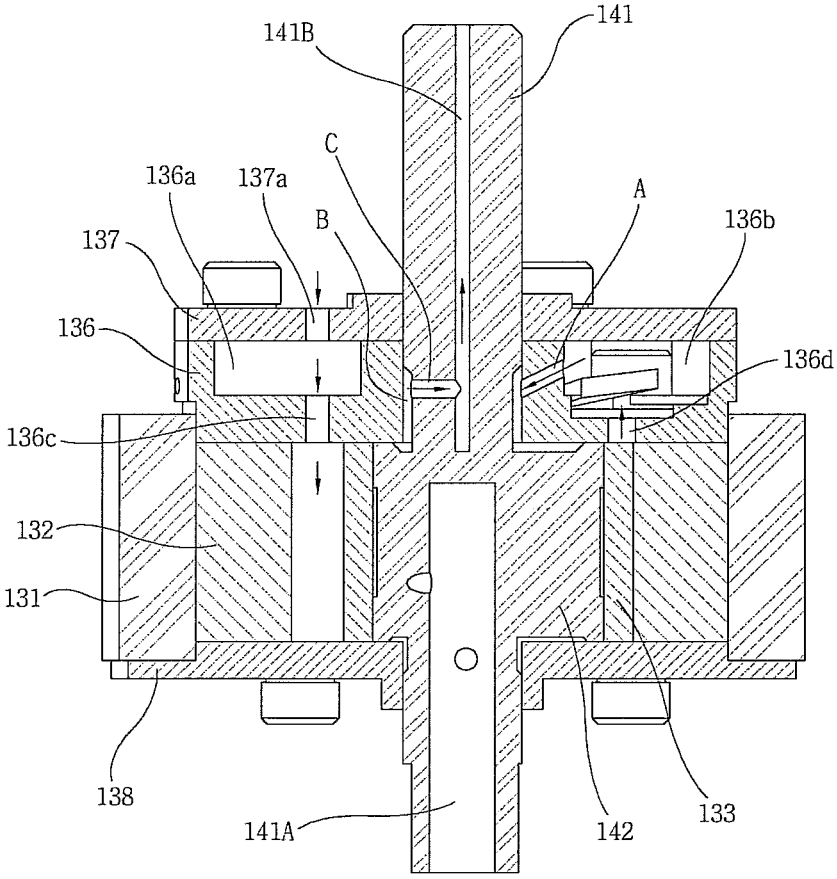
FIG. 10 is a side-sectional view of the refrigerant flow in a low-pressure type compressor according to the present invention.

FIG. 10 is a side-sectional view of the refrigerant flow in the low-pressure type compressor according to the present invention.

An embodiment of the low-pressure type compressor according to the present invention will be described with reference to FIG. 10. The suction pipe 115 (see FIG. 1) through which the refrigerant can be sucked is provided at an upper portion of the hermetic container 110 (see FIG. 1), and the refrigerant discharge passage 141B through which the refrigerant can be discharged is provided in a hollow space of an upper portion of the stationary shaft 141 fixed to the hermetic container 110 (see FIG. 1).

For the suction of the refrigerant, an inlet port 137*a* is provided in the muffler 137 to communicate with the suction chamber 136*a* of the upper bearing cover 136, and an inlet port 136*c* is provided in the upper bearing cover 136 to enable the suction chamber 136*a* of the upper bearing cover 136 and the suction pocket S (see FIG. 3) of the compression space to communicate with each other. Here, preferably, the inlet port 136*c* of the upper bearing cover 136 is located adjacent to one side of the vane 134 (see FIG. 3). As such, the low-pressure refrigerant is filled in the hermetic container 110 (see FIG. 1) through the suction pipe 115 (see FIG. 1) of the hermetic container 110 (see FIG. 1) and introduced into the suction pocket S (see FIG. 3) of the compression space through the inlet port 137*a* of the muffler 137, the suction chamber 136*a* of the upper bearing cover 136 and the inlet port 136*c* of the upper bearing cover 136.

For the discharge of the refrigerant, an outlet port 136*d* and a discharge valve (not shown) are provided in the upper bearing cover 136 to enable the compression pocket D (see FIG. 3) of the compression space and the discharge chamber 136*b* of the upper bearing cover 136 to communicate with each other, and discharge guide passages A, B and C are provided between the upper bearing cover 136 and the stationary shaft 141 to enable the discharge chamber 136*b* of the upper bearing cover 136 and the refrigerant discharge passage 141B of the stationary shaft 141 to communicate with each other. Contrary to the inlet port 136*c* of the upper bearing cover 136, the outlet port 136*d* of the upper bearing cover 136 is preferably located adjacent to the other side of the vane 134 (see FIG. 3) to reduce a dead volume. Moreover, the discharge guide passages A, B and C include a first discharge guide passage A penetrating through the shaft portion of the upper bearing cover 136 enclosing the upper portion of the stationary shaft 141, a second discharge guide passage B formed in an annular shape between an inner circumferential surface of the shaft portion of the upper bearing cover 136 and an outer circumferential surface of the upper portion of the stationary shaft 141 to communicate with the first discharge guide passage A, and a third discharge guide passage C formed at the upper portion of the stationary shaft 141 in the radial direction to enable the second discharge guide passage B and the refrigerant discharge passage 141B of the stationary shaft 141 to communicate with each other. Since the first discharge guide passage A is formed in the shaft portion of the upper bearing cover 136 by drilling processing, it is downwardly inclined toward the center. As such, the high-pressure refrigerant is discharged from the compression pocket D (see FIG. 3) of the compression space through the outlet port 136*d* of the upper bearing cover 136, and then discharged to the outside of the hermetic container 110 (see FIG. 1) through the discharge chamber 136*b* of the upper bearing cover 136, the discharge guide passages A, B and C between the upper bearing cover 136 and the stationary shaft 141, and the refrigerant discharge passage 141B of the stationary shaft 141. Here, the noise caused by the flow of the high-pressure refrigerant and the noise caused by the opening and closing of the discharge valve are reduced in the discharge chamber 136*b* between the upper bearing cover 136 and the muffler 137.

Figure 11:
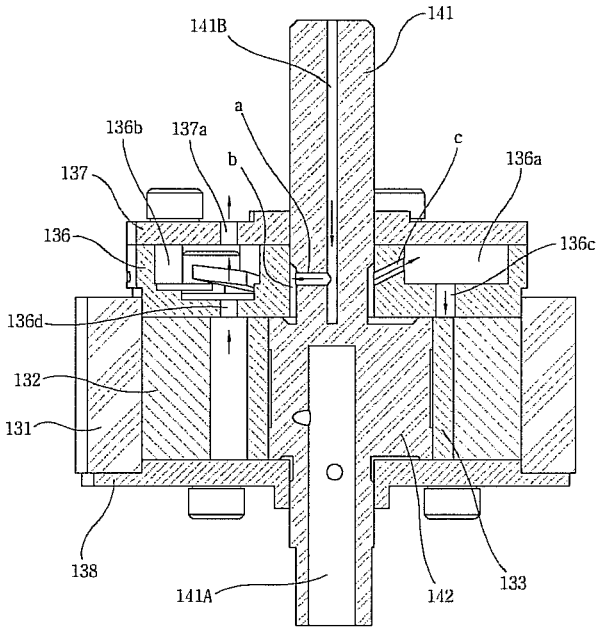
FIG. 11 is a side-sectional view of the refrigerant flow in a high-pressure type compressor according to the present invention.

FIG. 11 is a side-sectional view of the refrigerant flow in the high-pressure type compressor according to the present invention.

An embodiment of the high-pressure type compressor according to the present invention will be described with reference to FIG. 11. The refrigerant suction passage 141B through which the refrigerant can be sucked is provided in a hollow space of an upper portion of the stationary shaft 141 fixed to the hermetic container 110 (see FIG. 1), and the discharge pipe 115 (see FIG. 1) through which the refrigerant can be discharged is provided at an upper portion of the hermetic container 110 (see FIG. 1).

For the suction of the refrigerant, suction guide passages a, b and c are provided between the upper bearing cover 136 and the stationary shaft 141 to enable the refrigerant suction passage 141B of the stationary shaft 141 and the suction chamber 136*a* of the upper bearing cover 136 to communicate with each other, and an inlet port 136*c* is provided in the upper bearing cover 136 to enable the suction chamber 136*a* of the upper bearing cover 136 and the compression pocket D (see FIG. 3) of the compression space to communicate with each other. Here, the suction guide passages a, b and c include a first suction guide passage a formed at the upper portion of the stationary shaft 141 in the radial direction to communicate with the refrigerant suction passage 141B of the stationary shaft 141, a second suction guide passage b formed in an annular shape between an inner circumferential surface of the shaft portion of the upper bearing cover 136 and an outer circumferential surface of the upper portion of the stationary shaft 141 to communicate with the first suction guide passage a, and a third suction guide passage c penetrating through the shaft portion of the upper bearing cover 136 enclosing the upper portion of the stationary shaft 141 to communicate with the second suction guide passage b and the suction chamber 136*a* of the upper bearing cover 136. As the third suction guide passage c is formed in the shaft portion of the upper bearing cover 136 by drilling processing, it is downwardly inclined toward the center. Particularly, the inlet port 136*c* of the upper bearing cover 136 is located adjacent to one side of the vane 134 (see FIG. 3). As such, the low-pressure refrigerant is introduced into the refrigerant suction passage 141B of the stationary shaft 141, and then introduced into the suction pocket S (see FIG. 3) of the compression space through the suction guide passages a, b and c between the upper bearing cover 136 and the stationary shaft 141, the suction chamber 136*a* of the upper bearing cover 136, and the inlet port 136*c* of the upper bearing cover 136.

For the discharge of the refrigerant, an outlet port 137*d* and a discharge valve of the upper bearing cover 136 are provided to enable the discharge pocket D (see FIG. 3) of the compression space and the discharge chamber 136*b* of the upper bearing cover 136, and an outlet port 137*a* is provided in the muffler 137 to communicate with the discharge chamber 136*b* of the upper bearing cover 136. Contrary to the inlet port 136*c* of the upper bearing cover 136, the outlet port 136*d* of the upper bearing cover 136 is preferably located adjacent to the other side of the vane 134 (see FIG. 3) to reduce a dead volume. As such, the high-pressure refrigerant is discharged from the compression pocket D (see FIG. 3) of the compression space, passed through the outlet port 136*d* of the upper bearing cover 136, the discharge chamber 136*b* of the upper bearing cover 136, and the outlet port 137*a* of the muffler 137, filled in the hermetic container 110 (see FIG. 1), and then discharged to the outside of the hermetic container 110 (see FIG. 1) through the discharge pipe 115 (see FIG. 1) of the hermetic container 110 (see FIG. 1). Here, the noise caused by the flow of the high-pressure refrigerant and the noise caused by the opening and closing of the discharge valve are reduced in the discharge chamber 136*b* between the upper bearing cover 136 and the muffler 137.

While the high-pressure type refrigerant passage may be applied to the embodiment of the compressor according to the present invention, the low-pressure type refrigerant passage is more preferable. In the following description, the compressor adopting the low-pressure type refrigerant passage will be used to explain the lubrication structure in detail.

Figure 12:
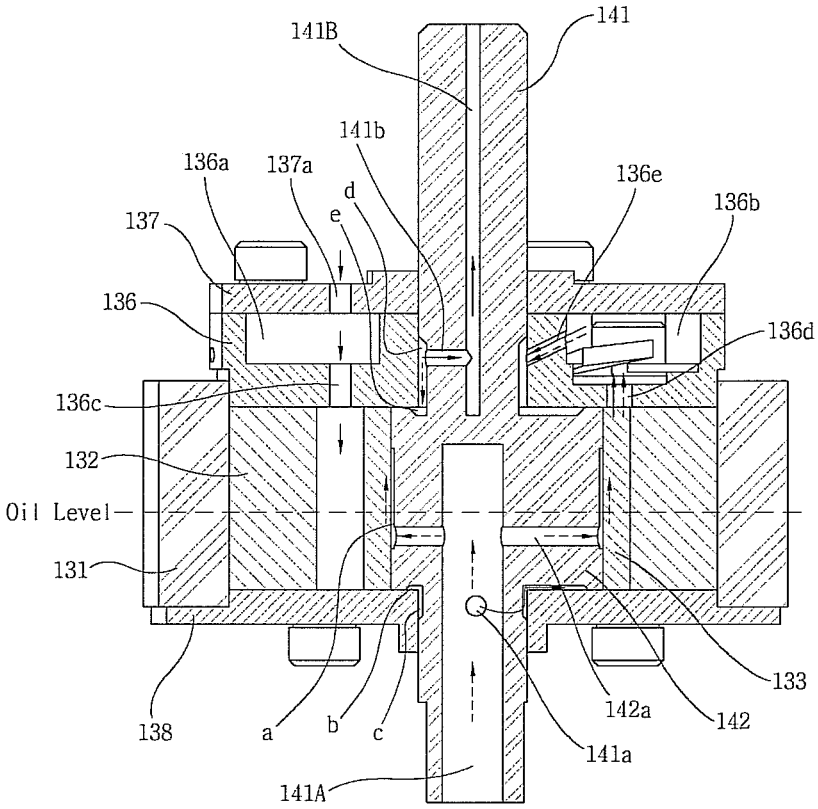
FIG. 12 is a side-sectional view of an example of upper and lower lubrication passages of the compressor according to the present invention.
Figure 13:
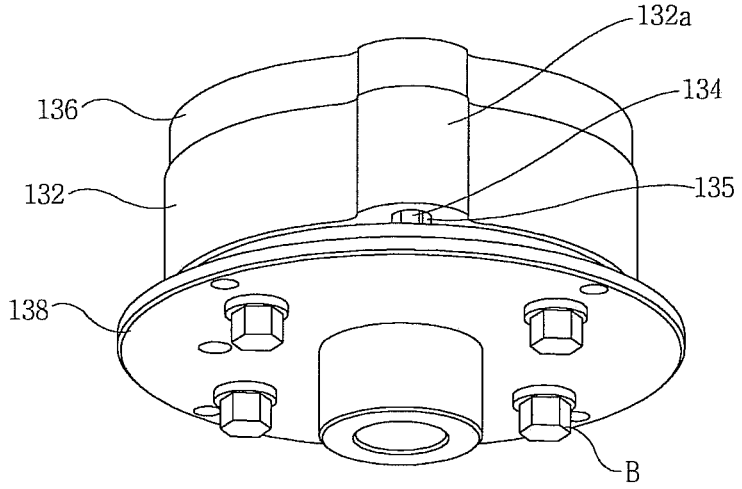
FIG. 13 is a perspective view of an example of a stationary shaft lubrication structure of the compressor according to the present invention.

FIG. 12 is a side-sectional view of an example of upper and lower lubrication passages of the compressor according to the present invention, and FIG. 13 is a perspective view of an example of a stationary shaft lubrication structure of the compressor according to the present invention.

As illustrated in FIGS. 12 and 13, the lower lubrication passage is provided to supply the oil stored in the hermetic container 110 (see FIG. 1) to contact portions of the lower bearing cover 138, the stationary shaft 141 and the eccentric portion 142, and the roller 133 through the communicating passage, and the upper lubrication passage is provided to supply the oil to contact portions of the upper bearing cover 136, and the stationary shaft 141 and the eccentric portion 142 through the passage through which the high-pressure refrigerant is discharged.

In more detail, the lower lubrication passage includes an oil supply passage 141A which is a hollow space vertically extending from a lower portion of the stationary shaft 141 to the eccentric portion 142, a first oil supply hole 142*a* penetrated through the eccentric portion 142 in the radial direction to communicate with the oil supply passage 141A, a first oil supply groove a formed between an outer circumferential surface of the eccentric portion 142 and an inner circumferential surface of the roller 133 to communicate with the first oil supply hole 142*a*, a second oil supply hole 141*a* penetrated through a lower portion of the stationary shaft 141 in the radial direction to communicate with the oil supply passage 141A, and second oil supply grooves b and c formed in a bottom surface of the eccentric portion 142 brought into contact with the lower bearing cover 138 and an outer circumferential surface of the stationary shaft 141 directly below the eccentric portion 142 so as to communicate with the second oil supply hole 141*a*. Here, the first oil supply groove a may be formed in any of the contact portions of the roller 133 and the eccentric portion 142, but is preferably formed in the outer circumferential surface of the eccentric portion 142 having a relatively large thickness and an easy machining property. In addition, the second oil supply grooves b and c may be formed in any of the contact portions of the lower bearing cover 138 and the stationary shaft 141 and the eccentric portion 142, but are preferably formed as annular grooves having a side section of '¬' in the outer circumferential surface of the lower portion of the stationary shaft 141 and the bottom surface of the eccentric portion 142 of a relatively large thickness and an easy machining property. Moreover, an oil pumping member may be employed. Preferably, an oil level of the oil stored in the hermetic container 110 is maintained higher than the first oil supply hole 142*a* such that the oil is supplied through the lower lubrication passage at the absence of the oil pumping member. Further, a spiral groove (not shown) supplying the oil to the second oil supply grooves b and c may be provided in an inner circumferential surface of the shaft portion of the lower bearing cover 138 enclosing the lower portion of the stationary shaft 141.

The upper lubrication passage includes an oil separation hole 136*e* penetrating through the shaft portion of the upper bearing cover 136 enclosing the upper portion of the stationary shaft 141, and third oil storage grooves d and e formed in a top surface of the eccentric portion 142 brought into contact with the upper bearing cover 136 and an outer circumferential surface of the stationary shaft 141 directly over the eccentric portion 142 so as to communicate with the oil separation hole 136*e*. Since the oil separation hole 136*e* is formed in the shaft portion of the upper bearing cover 136 by drilling processing, it is downwardly inclined toward the center. Here, the third oil storage grooves d and e may be formed in any of the contact portions of the upper bearing cover 136 and the stationary shaft 141 and the eccentric portion 142, but are preferably formed as annular grooves having a side section of '└' in the outer circumferential surface of the upper portion of the stationary shaft 141 and the top surface of the eccentric portion 142 of a relatively large thickness and an easy machining property. Preferably, the upper lubrication passage is located lower than the refrigerant discharge passage 141B to separate the oil from the high-pressure refrigerant. As described above, the upper lubrication passage guides the high-pressure refrigerant containing the oil to the discharge chamber 136*b* of the upper bearing cover 136 and the refrigerant discharge passage 141B of the stationary shaft 141, and thus may be considered as a kind of discharge guide passage.

Therefore, the oil stored in the lower portion of the hermetic container 110 (see FIG. 1) is introduced into the first and second oil supply grooves a, b and c through the oil supply passage 141A and the first and second oil supply holes 142*a* and 141*a*. The oil collected in the first oil supply groove a lubricates between the roller 133 and the eccentric portion 142 such that the roller 133 is rotatable on an outer circumferential surface of the eccentric portion 142. The oil collected in the second oil supply grooves b and c lubricates between the lower bearing cover 138, and the stationary shaft 141 and the eccentric portion 142 such that the lower bearing cover 138 brought into contact with the stationary shaft 141 and the eccentric portion 142 is rotatable.

As set forth herein, since the oil level of the oil stored in the hermetic container 110 (see FIG. 1) is formed higher than the first oil supply hole 142*a*, the oil is compressed in the compression space with the refrigerant and discharged to the outlet port 136*d* and the discharge chamber 136*b* of the upper bearing cover 136. When the high-pressure refrigerant containing the oil is introduced into the third oil supply grooves d and e through the oil separation hole 136*e*, the oil is separated from the refrigerant and left in the third oil supply grooves d and e, but the refrigerant separated from the oil is discharged from the hermetic container 110 (see FIG. 1) through the discharge guide passage 141*b* penetrated through an outer circumferential surface of the upper portion of the stationary shaft 141 in the radial direction and the refrigerant discharge passage 141B penetrated through the upper portion of the stationary shaft 141 in the axial direction to communicate with the discharge guide passage 141*b*. Here, the oil collected in the third oil supply grooves b and c lubricates between the upper bearing cover 136 and the stationary shaft 141 and the eccentric portion 142 such that the upper bearing cover 136 brought into contact with the stationary shaft 141 and the eccentric portion 142 is rotatable.

Figure 14:
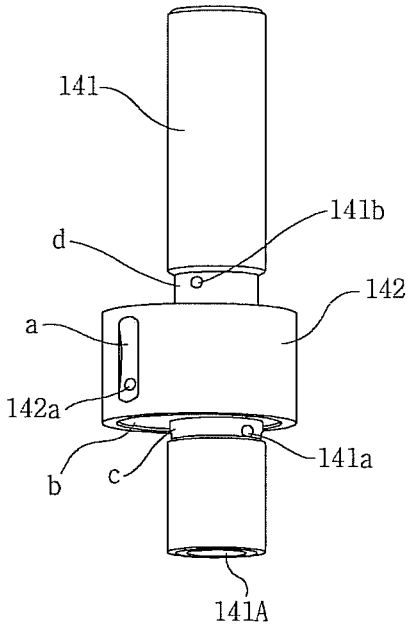
FIG. 14 is a perspective view of an example of a vane lubrication structure of the compressor according to the present invention.

FIG. 14 is a perspective view of an example of a vane lubrication structure of the compressor according to the present invention.

As illustrated in FIG. 14, the upper and lower bearing covers 136 and 138 are bolt-fastened to the rotor 131 (see FIG. 2) or the cylinder 132 in the axial direction. As described above, if the cylinder-type rotor in which the rotor 131 (see FIG. 2) and the cylinder 132 are integrally formed is employed, the upper and lower bearing covers 136 and 138 are bolt B-fastened to the cylinder-type rotor at a time. Meanwhile, if the cylinder-type rotor in which the rotor 131 (see FIG. 2) and the cylinder 132 are separately formed is employed, the upper and lower bearing covers 136 and 138 may be bolt B-fastened to the rotor 131 (see FIG. 2) and the cylinder 132, respectively, or bolt B-fastened only to the cylinder 132. In the embodiment of the present invention, the cylinder-type rotor in which the rotor 131 (see FIG. 2) and the cylinder 132 are separately formed is employed, and the upper bearing cover 136 and the lower bearing cover 138 are bolt B-fastened to the cylinder 132, respectively. Here, the lower bearing cover 138 is installed to cover the bottom surface of the cylinder 132. Preferably, the lower bearing cover 138 is installed without covering the coupling protrusions 132*a* protruding from an outer circumferential surface of the cylinder 132 to be die-matched with the rotor 131 (see FIG. 2) and a part of the vane mounting hole 132H provided in the coupling protrusion 132*a*. For example, a part of the lower bearing cover 138 corresponding to at least a part of the vane mounting hole 132H is provided with a stepped portion, removed or provided with an additional oil supply hole. The oil stored in the hermetic container 110 (see FIG. 1) maintains a higher oil level than the level of the lower bearing cover 138 such that the bottommost end of the vane mounting hole 132H can be immersed therein. Therefore, when the oil is introduced into the vane mounting hole 132H of the cylinder 132 which is not covered with the lower bearing cover 138, the vane 134 can be smoothly linearly reciprocated between the vane mounting hole 132H and the bushings 135.

The present invention has been described in connection with the exemplary embodiments and the accompanying drawings. However, the scope of the present invention is not limited thereto but is defined by the appended claims.

The invention claimed is:

1. A compressor, comprising:

a hermetic container into and from which a refrigerant is sucked and discharged, respectively;

a stator fixed in the hermetic container;

a stationary member including a stationary shaft formed in a cylindrical shape and having both ends immovably installed in the hermetic container, and an eccentric portion formed in a cylindrical shape, having a diameter larger than a diameter of the stationary shaft, that protrudes from the stationary shaft in the entire radial direction of the stationary shaft, and is eccentrically formed on the stationary shaft;

a rotary member including a cylinder-type rotor that rotates around the stationary shaft by a rotating electromagnetic field from the stator, a roller formed in a cylindrical shape and applied with a rotation force from the cylinder-type rotor, that rotates around the eccentric portion of the stationary member with the cylinder-type rotor, wherein a compression space is defined between the roller and the cylinder-type rotor, and a vane fixedly formed on the roller that protrudes from an outer circumferential surface of the roller to the cylinder-type rotor, transfers the rotation force from the cylinder-type rotor to the rollers and partitions the compression space into a suction pocket into which the refrigerant is sucked and a compression pocket in and from which the refrigerant is compressed and discharged, respectively, wherein a vane mounting hole is formed in the cylinder-type rotor to accommodate the protruding vane, and wherein the cylinder-type rotor and the roller rotate together such that opposite portions are repeatedly brought into close and distant positions; and upper and lower bearing covers that form upper and lower portions of the rotary member, rotate with the rotary member, rotatably support the rotary member with respect to the stationary member, and define the compression space in the rotary member, wherein inner circumferential surfaces of the upper and lower beating covers are rotatably journal-supported on the stationary shaft, and wherein a bottom surface of the upper bearing cover is rotatably thrust-supported on a top surface of the eccentric portion of the stationary member.

2. The compressor of claim 1, further comprising an upper shaft holder that fixes a top end of the stationary shaft to an upper portion of the hermetic container, and a lower shaft holder that fixes a bottom end of the stationary shaft to a lower portion of the hermetic container.

3. The compressor of claim 2, wherein a lower shaft holder-side end portion of the lower bearing cover, which is rotatably journal-supported on the stationary shaft, is rotatably thrust-supported on a top surface of the lower shaft holder.

4. The compressor of claim 2, further comprising a lower lubrication passage provided between the stationary shaft and the eccentric portion, and the roller to supply oil stored in the hermetic container between the eccentric portion and the roller.

5. The compressor of claim 1, wherein the cylinder-type rotor comprises a cylinder that defines the compression space between the roller and the cylinder-type rotor, and a rotor formed by stacking a plurality of iron pieces in an axial direction such that a plurality of permanent magnets is inserted into a plurality of holes formed in the stacked plurality of iron pieces to face the stator, and wherein the cylinder and the rotor are die-matched with each other.

6. The compressor of claim 1, wherein the cylinder-type rotor is integrally formed by powder sintering such that a plurality of permanent magnets is inserted into a plurality of holes formed in a powder-sintered body to face the stator.

7. The compressor of claim 1, wherein the cylinder-type rotor is formed by stacking a plurality of iron pieces in an axial direction such that a plurality of permanent magnets is inserted into a plurality of holes formed in the stacked plurality of iron pieces to face the stator, and wherein an inner surface of the stacked plurality of iron pieces forms an inner surface of the cylinder-type rotor.

8. The compressor of claim 1, further comprising:

an inlet port formed in either the upper or lower bearing cover to enable the refrigerant to be sucked into the compression space; and a refrigerant suction passage that communicates with an inner space of the hermetic container to enable a low-pressure refrigerant in the inner space to be sucked into the compression space through the inlet port.

9. The compressor of claim 8, wherein at least a part of the stationary shaft is formed as a hollow shaft to communicate with an outside of the hermetic container, and wherein the compressor further comprises:

an outlet port formed in either the upper or lower bearing cover to discharge the refrigerant compressed in the compression space; and a refrigerant discharge passage that isolates the compressed refrigerant discharged through the outlet port from the inner space of the hermetic container and discharges the compressed refrigerant to the outside of the hermetic container through the hollow shaft of the stationary shaft.

10. The compressor of claim 9, wherein a muffler is rotatably supported with respect to the stationary shaft to form a discharge chamber for a noise space of the compressed refrigerant discharged through the outlet port in the bearing cover with the outlet port therein, and the refrigerant discharge passage further includes a discharge guide passage to guide the compression refrigerant from the discharge chamber to the hollow shaft of the stationary shaft.

11. The compressor of claim 10, wherein the inlet port and the outlet port are formed in the upper bearing cover, the low-pressure refrigerant is sucked into the compression space through an inlet port formed in the muffler, the suction chamber being formed between the muffler and the upper bearing cover, and the inlet port of the upper bearing cover, and the compression refrigerant is guided to the hollow shaft of the stationary shaft through the outlet port of the upper bearing cover, the discharge chamber being formed between the muffler and the upper bearing cover and being isolated from the suction chamber, a first discharge guide passage that penetrates through a shaft portion of the upper bearing cover to enclose an upper portion of the stationary shaft, a second discharge guide passage formed in an annular shape between an inner circumferential surface of the shaft portion of the upper bearing cover and an outer circumferential surface of the upper portion of the stationary shaft to communicate with the first discharge guide passage, and a third discharge guide passage formed to enable the second discharge guide passage and the hollow space of the upper portion of the stationary shaft to communicate with each other, and discharged to the outside of the hermetic container.

12. The compressor of claim 8, further comprising a lower lubrication passage provided between the stationary shaft and the eccentric portion, and the roller to supply oil stored in the hermetic container to between the eccentric portion and the roller.

13. The compressor of claim 12, wherein a groove is formed along an inner circumferential surface of the lower bearing cover to supply the oil, wherein the inner circumferential surface of the lower bearing cover is in contact with an outer circumferential surface of a bottom end of the stationary shaft, and wherein the groove of the lower bearing cover communicates with the lower lubrication passage.

14. The compressor of claim 12, wherein the vane is integrally formed with the roller, and wherein at least a part of a bottommost end of the vane mounting hole is open to communicate with the oil stored in the hermetic container.

15. The compressor of claim 12, further comprising an upper lubrication passage provided between the stationary shaft and the eccentric portion, and the upper bearing cover to separate the oil compressed in the compression space with the refrigerant and supply the oil to between the eccentric portion and the upper bearing cover.

16. The compressor of claim 1, further comprising a lower lubrication passage provided between the stationary shaft and the eccentric portion, and the roller to supply oil stored in the hermetic container between the eccentric portion and the roller.

17. The compressor of claim 16, wherein a groove is formed along the inner circumferential surface of the lower bearing cover to supply the oil wherein the inner circumferential surface of the lower bearing cover is in contact with an outer circumferential surface of a bottom end of the stationary shaft, and wherein the groove of the lower bearing cover communicates with the lower lubrication passage.

18. The compressor of claim 16, wherein the vane is integrally formed with the roller, and wherein at least a part of a bottommost end of the vane mounting hole is open to communicate with the oil stored in the hermetic container.

19. The compressor of claim 16, further comprising an upper lubrication passage provided between the stationary shaft and the eccentric portion, and the upper bearing cover to separate the oil compressed in the compression space with the refrigerant and supply the oil to between the eccentric portion and the upper bearing cover.

* * * * *